US005879272A

United States Patent [19]

Mekjian

[11] Patent Number: 5,879,272

[45] Date of Patent: Mar. 9, 1999

[54] ADJUSTABLE PHYSICAL THERAPY APPARATUS

[76] Inventor: John H. Mekjian, 35959 Elmira, Livonia, Mich. 48150

[21] Appl. No.: 912,246

[22] Filed: Aug. 15, 1997

[51] Int. Cl.[6] ..... A63B 22/00

[52] U.S. Cl. ..... 482/51; 482/25; 482/28; 482/131; 482/907

[58] Field of Search ..... 482/14, 15, 25, 482/26–32, 51, 52, 71, 77, 79, 131, 139, 142, 907, 908

[56] References Cited

U.S. PATENT DOCUMENTS

| | | | |
|---|---|---|---|
| D. 219,745 | 1/1971 | Windscheffel . | |
| 2,021,804 | 11/1935 | Meyer | 482/79 |
| 4,483,531 | 11/1984 | Laseman et al. | 482/27 |
| 4,531,730 | 7/1985 | Chenera . | |
| 4,650,187 | 3/1987 | Chenera . | |
| 4,730,826 | 3/1988 | Sudmeier | 482/71 |
| 4,757,994 | 7/1988 | Chenera . | |
| 4,795,150 | 1/1989 | Harlan | 482/142 |
| 4,824,100 | 4/1989 | Hall et al. | 482/71 |
| 5,125,650 | 6/1992 | Paris | 482/142 |
| 5,232,426 | 8/1993 | Van Staaten | 482/123 |
| 5,389,055 | 2/1995 | Gangloff | 482/38 |
| 5,620,404 | 4/1997 | Eyman | 482/142 |

*Primary Examiner*—Jeanne M. Clark
*Attorney, Agent, or Firm*—Miller, Morriss & Pappas

[57] ABSTRACT

An adjustable physical therapy apparatus consisting of a support base. A horizontally oriented bounding platform assembly support bar is selectively mounted on the support base so as to be vertically adjustable with respect thereto. A bounding platform assembly consists of two pivotally connected bounding platforms which are selectively draped over the support bar so that the free ends thereof rest upon the floor. The angle of inclination of the pivotally connected bounding platforms is selectivley variable by vertically adjusting the support bar with respect to the support base so as to provide bounding surfaces for vigorous lateral rehabilitation exercises by the patient.

A modified adjustable physical therapy apparatus is provided whereby two adjustable physical therapy units are fixedly attached in an end-to-end relationship so as to provide adjacent bounding platforms with a reverse angle of inclination so as to provide bounding surfaces for vigorous medial rehabilitation exercises by the patient.

2 Claims, 6 Drawing Sheets

ADJUSTABLE PHYSICAL THERAPY APPARATUS

This invention relates to an adjustable physical therapy apparatus which is specifically adaptable for selective rehabilitation exercises by a patient to improve the strength and stability of injured joints in the lower body extremities, i.e. the ankles, knees and hips.

This invention also relates to an adjustable physical therapy apparatus having opposed inclined platforms which enable the patient to perform selective bilateral bounding activity on the inclined platforms by pushing off with one leg from one inclined platform and landing with the other leg on the opposite inclined platform with resultant beneficial rehabilitating stress along the lateral aspects of the joints as the bounding activity is repeated with resultant increased strength in the injured joint.

This invention further relates to an adjustable physical therapy apparatus provided with variable angle of inclination control means whereby the angle of inclination of the opposed inclined or slanted platforms can selectively be varied from a low level of incline to a high level of incline so as to selectively increase the stress level as the patient's rehabilitation improves to a full recovery of the injured joint.

This invention also relates to an adjustable physical therapy apparatus whereby the angle of inclination of the inclined or slanted opposed platforms can be easily varied without the use of expensive mechanical adjustment assemblies.

This invention also relates to an adjustable physical therapy apparatus whereby the user can safely perform vigorous lateral bounding activities thereon without encountering ancillary platform support brackets which could injure the user.

This invention also relates to an alternate use of the adjustable physical therapy apparatus whereby two adjustable physical therapy devices as described herein are placed end-to-end so as to provide a bounding surface for use by the patient which provides reversely inclined platforms to provide stress to the medial aspects of the injured ankles and knees as opposed to the single unit stress provided to the lateral aspects of the injured ankles and knees.

In summary, this invention also relates to an adjustable physical therapy apparatus which is safe to use. Further, it is easy and inexpensive to manufacture. In addition, it is easy to assemble into its operative use position and can be easily folded into a compact storage configuration. In closing, this invention provides a structure which permits the user to gradually strengthen and rehabilitate injured ankles, knees and hips while performing selective vigorous bilateral bounding activity thereon.

It is therefore an object of this invention to provide an adjustable physical therapy apparatus which provides safety and ease in use while a user performs vigorous selective bilateral bounding activity thereon with resultant rehabilitating stress which results in gradual strengthening of the injured joints.

Another object of this invention is to provide an adjustable physical therapy apparatus having variable angle of inclination control means which permits the user to easily raise the angle of inclination of the inclined or slanted platforms from an initial low angle of inclination to selectively higher inclinations of the platform as the user progresses in his rehabilitation program to resultant full rehabilitation of his injured joints.

Yet another object of this invention is to provide an adjustable physical therapy apparatus which is easy and inexpensive to manufacture without the use of complicated mechanical adjustment assemblies and ancillary support brackets or structures which interfere with patients use of the adjustable physical therapy apparatus.

A still further object of this invention is to provide an adjustable physical therapy structure which can be easily assembled and disassembled for use in storage or transport.

By way of background information, it should be noted that in the rehabilitation of injuries it is important to utilize a variety of strengthening activities. Closed kinetic chain exercise has become a popular and vital part of all rehabilitation protocols because they closely simulate functional activities. Closed kinetic chain exercises place stress through the joint and surrounding soft tissue. These stresses are similar to those found with every day activities except that the resistance is increased resulting in increased strength of muscles, tendons and ligaments.

Lower extremity rehabilitation is no exception. There are an infinite number of exercises that can be performed to strengthen every joint in the lower extremity. When rehabilitating lower extremity injuries it is important to stress a specific joint in a safe environment so as to prevent re-injury. Closed kinetic chain activities satisfy both of these needs by safely placing stress through an injured joint.

The intention of this device is to place stress across joints of the lower extremity in order to improve the strength and stability of these joints, yet not to cause injury during these activities.

In the designed usage of the invention, the patient will perform a bilateral bounding activity on the inclined or slanted platforms. This is accomplished by pushing off with one leg and landing on the opposite half of the slanted platform with the opposite leg. The bounding sequence is repeated by the patient immediately thrusting back to the opposite slanted platform. This activity will be performed continuously during which the lateral aspects of the ankle, knee and hip will be stressed. Initially, the patient may begin at a low level of incline, and as they progress along with their therapy, the angle of inclination can be increased. As a result, the stress placed along the lateral aspects of the joints will be increased, thereby increasing the strength of the joint.

As will be hereinafter described, two of these devices can be placed end to end so that the angle of inclination is such that the height of the bounding board is lower in the center and greater on the outside, which is opposite of the single unit where the angle of inclination is such that height of the bounding board is greater in the center and lower on the outside. When using this device in this fashion, more stress would be placed on the medial aspects of the ankle and knee, thereby improving the stability and strength of these joints. The same philosophy holds true with the angle of inclination, first beginning at a low level and then gradually increasing them as the strength of the joints increase.

Other objects and advantages found in the construction and use of the invention will be apparent from a consideration in connection with the appended specification, drawings and appended claims.

IN THE DRAWINGS

DESCRIPTION

Figure 1:
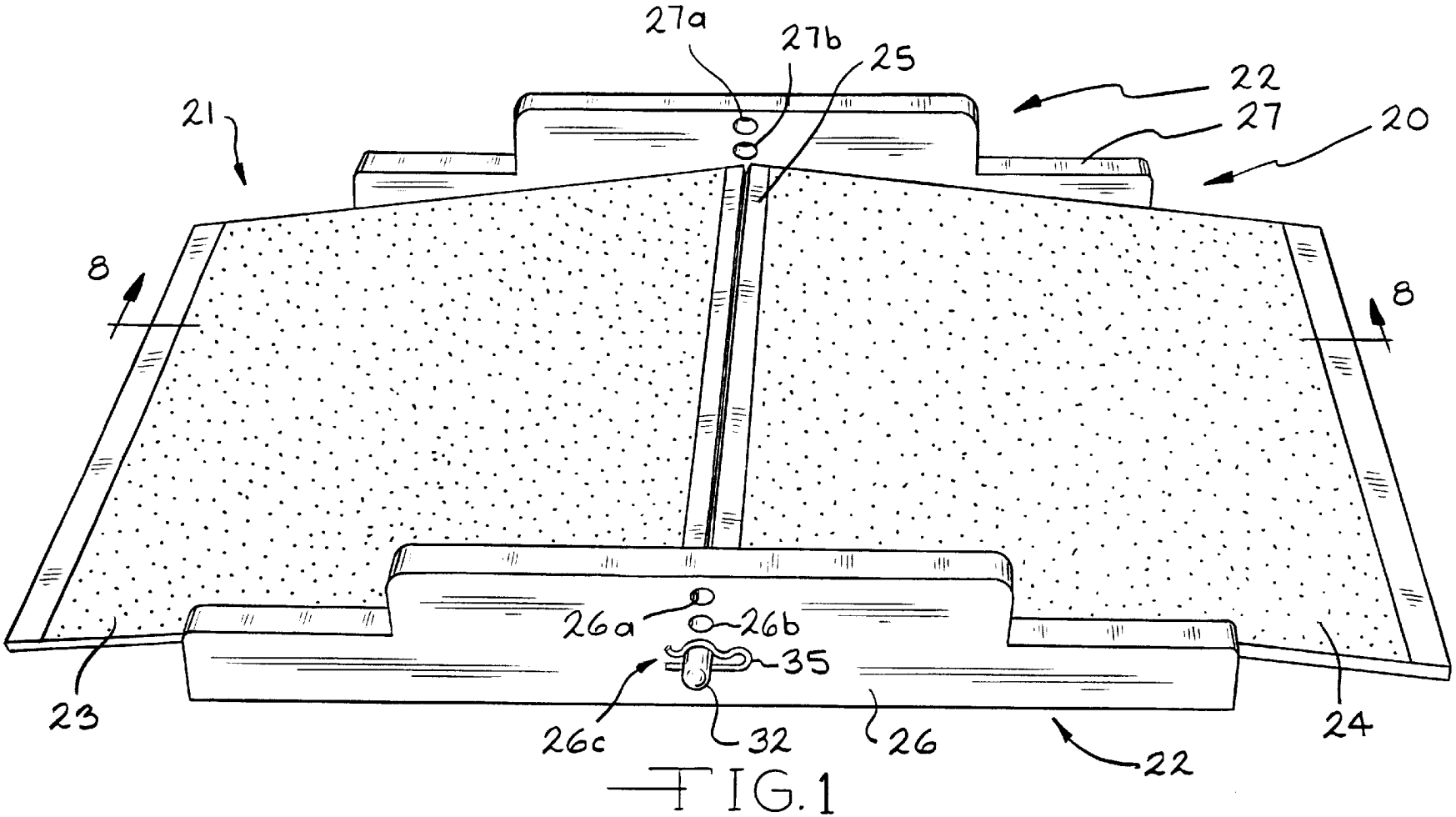
FIG. 1 is a frontal perspective view showing an embodiment of the adjustable physical therapy apparatus showing the inclined platform assembly in its use position on its support structure.

As shown in the frontal perspective view of FIG. 1, an embodiment of the adjustable physical therapy apparatus 20 is shown in its operational use position with the platform assembly 21 in its use position on the support base 22.

Figure 7:
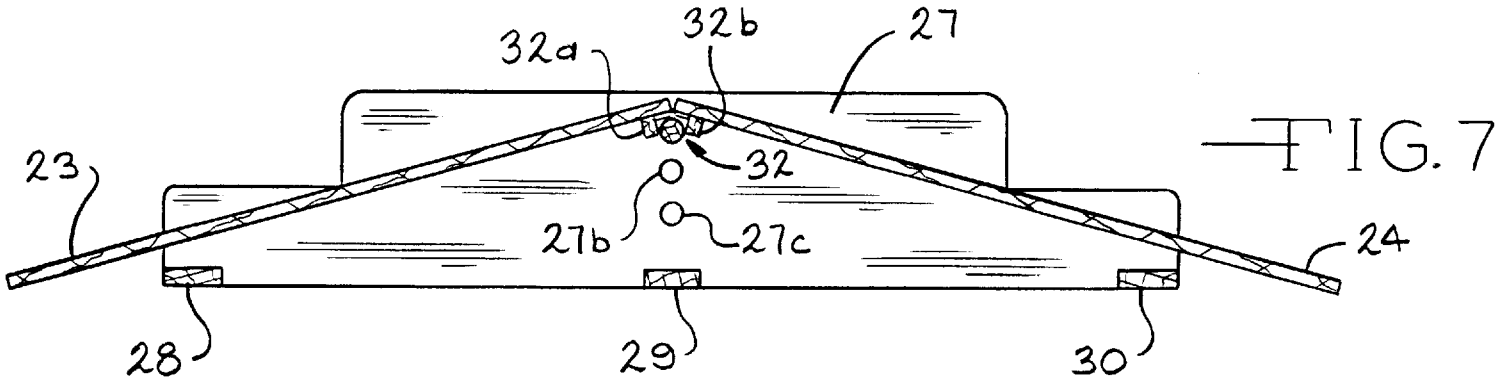
FIG. 7 is a schematic cross-sectional view thereof showing the inclined platform assembly in its highest angle of inclination.
Figure 8:
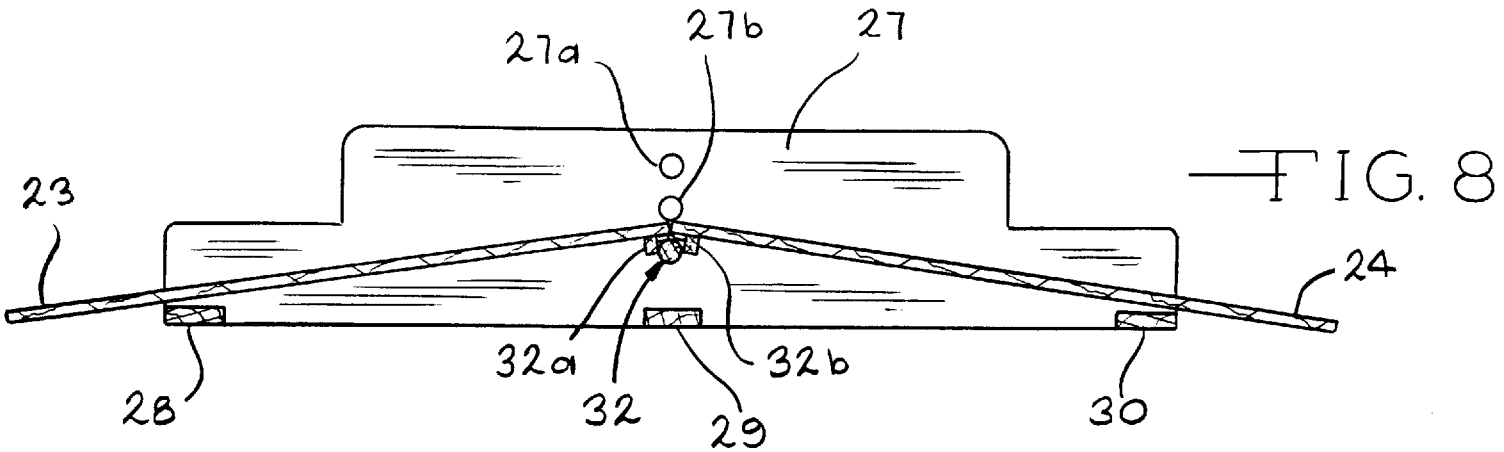
FIG. 8 is a schematic cross-sectional view thereof taken on lines 8—8 of FIG. 1 showing the inclined platform assembly in its lowest angle of inclination.
Figure 9:
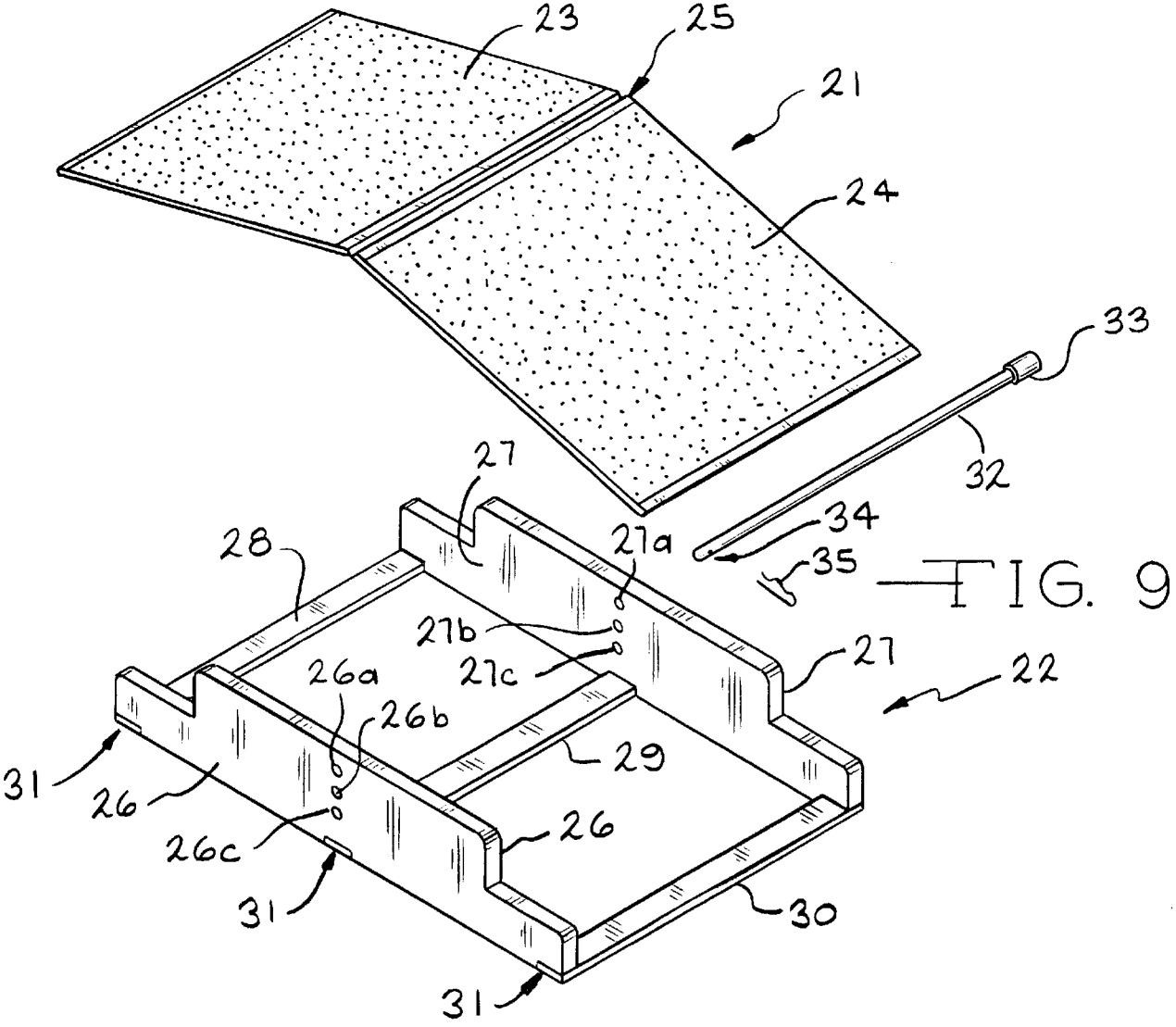
FIG. 9 is a schematic exploded perspective view showing the components of the adjustable physical therapy apparatus.

As shown generally in the drawings and more specifically in FIGS. 7, 8 and 9, the platform assembly 21 comprised of two bounding platforms 23 and 24, respectively, which are pivotally connected together in an end to end relationship by use of a standard hinge member 25 which extends transversely fully across the ends of the platforms 23 and 24 being thus connected. Although a hinge 25 is used in the preferred embodiment, it is within the scope of the invention to use standard hooks and eyes or even an elongate rubber or canvass strip (not shown) to pivotally and flexibly connect the ends of the platforms 23 and 24 in an end-to-end relationship.

It is also within the scope of this invention to utilize variable angle of inclination control means to selectively vary the angle of inclination of the bounding platforms as desired in use. Any type of angle of inclination control means can be used, as long as such means do not extend above the bounding platforms into the bounding area used by patients.

One embodiment of the adjustable plysical therapy apparatus is shown generally in the drawings. As specifically shown in FIG. 9, the support base 22 is comprised of front and rear support walls 26 and 27 respectively, which are in spaced-apart parallel register with each other so as to selectively receive the platform assembly 21 therebetween.

The front support wall 26 and the rear support wall 27 are held in their aligned spaced-apart parallel register position with each other by use of cross bars 28, 29 and 30 positioned in cross bar receiving recesses 31 provided in the bottom surfaces of the front and rear support walls 26 and 27, respectively.

Although this embodiment of the support base 22 is fabricated from wood stock components, it is within the scope of the invention to utilize plastic to manufacture a light-weight strong unitary support base which is easy and inexpensive to build.

In its operative use position, the platform assembly 21 is freely positioned within the support base 22 between the front and rear support wall 26 and 27, respectively.

The platform assembly 21 is positioned on and supported by the platform assembly support rod 32. Each of the bounding platforms 23 and 24, respectively, is provided with transversely positioned downwardly extending fixed elongate support rod stop bars 32*a* and 32*b*, respectively. When the platform assembly 21 is in its operative use position supported by the platform assembly support rod 32, the support rod 32 is positioned in its spaced-apart support position below the hinge member 25 and is coextensive therewith. Thus positioned, the hinged ends of the platforms 23 and 24 respectivley, rest upon and are freely supported by the entire length of the support rod 32, as shown in FIGS. 7 and 8. With the platform assembly 21 thus positioned on the support rod 32, the support rod 32 is bracketed between the stop bars 32*a* and 32*b* so as to stabilize and prevent the platform assembly 21 from moving while it is being used by a patient undergoing physical therapy as described herein.

The front support wall 26 and the rear wall 27 are provided with centrally positioned vertical aligned platform assembly support rod receiving holes 26*a*, 26*b* and 26*c* and 27*a*, 27*b* and 27*c*, respectively, which are in selective corresponding registry with each other so as to selectively receive a platform assembly support rod 32 therethrough. The support rod receiving holes selectively coact with the support rod 32 to selectively control and vary the angle of inclination of the bounding platform assembly 21 supported upon the support rod 32.

The platform assembly support rod 32 is provided with an enlarged support wall engaging retainer head 33 at one end thereof and a retainer pin receiving hole 34 at the opposite end thereof.

A retainer lock pin 35 is provided for selectivley engaging the retainer pin receiving hole 34 so as to retain the platform assembly support rod 32 in its operative use position in engagement with the support walls 26 and 27, respectively.

As shown specifically in FIGS. 1, 7 and 8, the opposed bounding support platforms 23 and 24, respectively, extend downwardly from the hinge member 25 in opposite directions until the outer end portions thereof freely contact the floor surface upon which the support base 22 is positioned.

If a steep angle of inclination is desired for the bounding platforms 23 and 24, respectively, the platform assembly support rod 32 is positioned through the corresponding support rod receiving holes 26*a* and 27*a* provided in the front and rear walls 26 and 27 of the support base 22. This is shown specifically in the sectional view of FIG. 7.

If an intermediate angle of inclination is desired for the bounding platforms 23 and 24, the support rod 32 is selectively positioned through the corresponding support rod receiving holes 26*b* and 27*b*. The intermediate position is not shown in the drawings.

Figure 2:
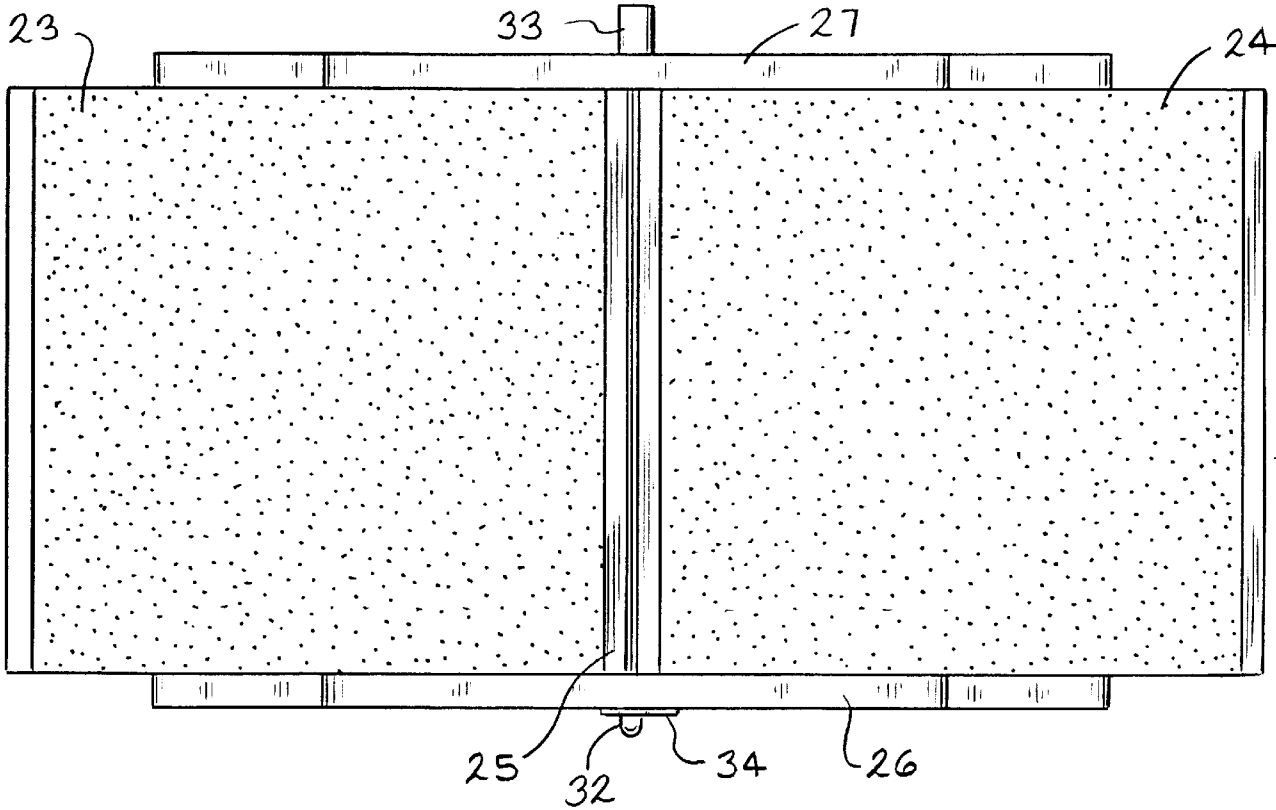
FIG. 2 is a top view thereof.
Figure 3:
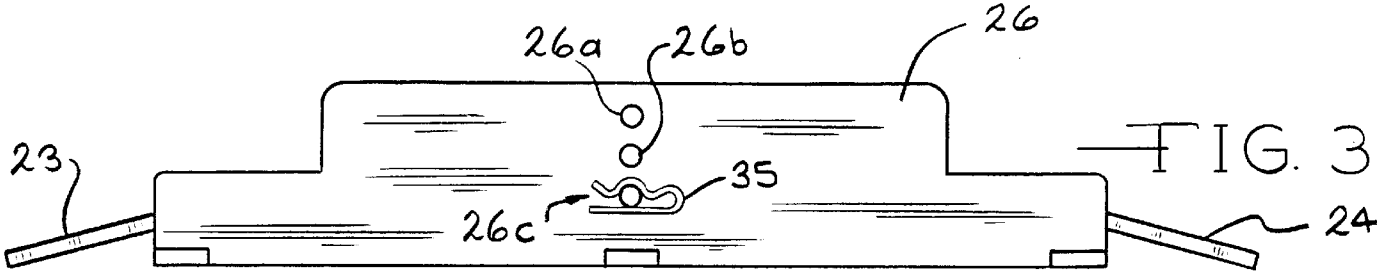
FIG. 3 is a front elevational view thereof.
Figure 4:
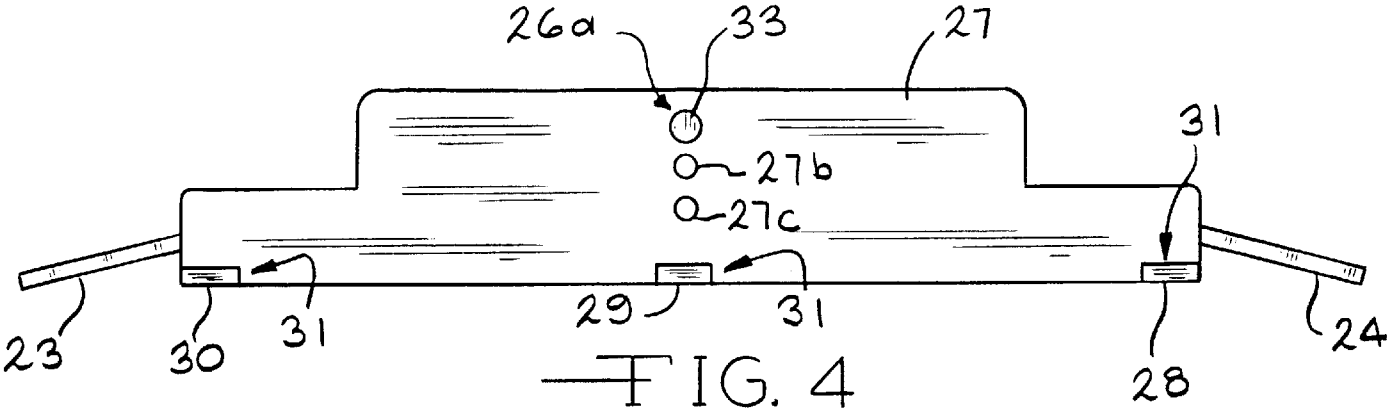
FIG. 4 is a rear elevational view thereof.
Figure 6:
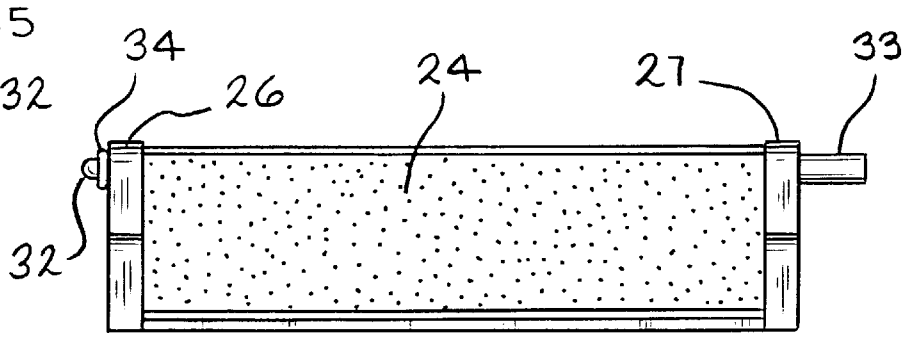
FIG. 6 is a right side elevational view thereof.
Figure 5:
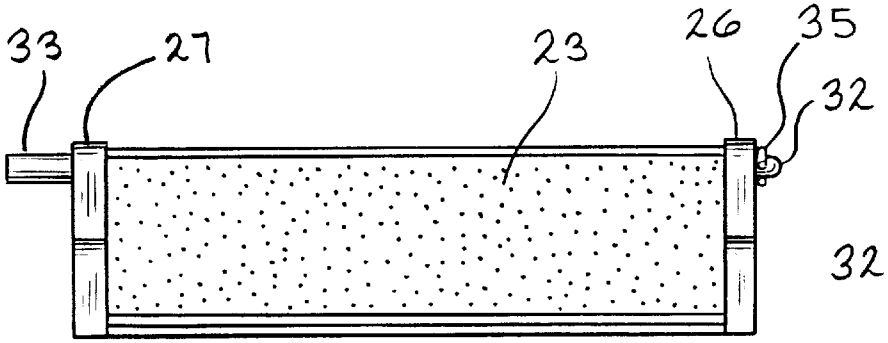
FIG. 5 is a left side elevational view thereof.

If the smallest angle of inclination is desired for the bounding platforms, the support rod 32 is selectivley positioned through the corresponding support rod receiving holes 26*c* and 27*c* as shown in FIGS. 1, 2 and 8.

Although the embodiment of the invention shown in the drawings illustrates support rod dowel means 32 which can be selectively varied in height so as to selectively change the angle of inclination of the bounding boards 23 and 24 by coaction with vertical aligned support rod receiving holes provided in the front and rear walls 26 and 27, it is within the scope of the invention to provide selectively variable angle of inclination control means which consist of a cam system with a locking mechanasim so as to make the adjustment easier and safer. The use of such a cam system variable elevation means would eliminate the need to remove the bounding board assembly in order to selectively change the angle of inclination of the bounding boards. Other variable elevation changing support means which are well known in the art can also be used to automate the changing of the angle of inclination process if desired so as to expedite the change of the angle of inclination.

Figure 10:
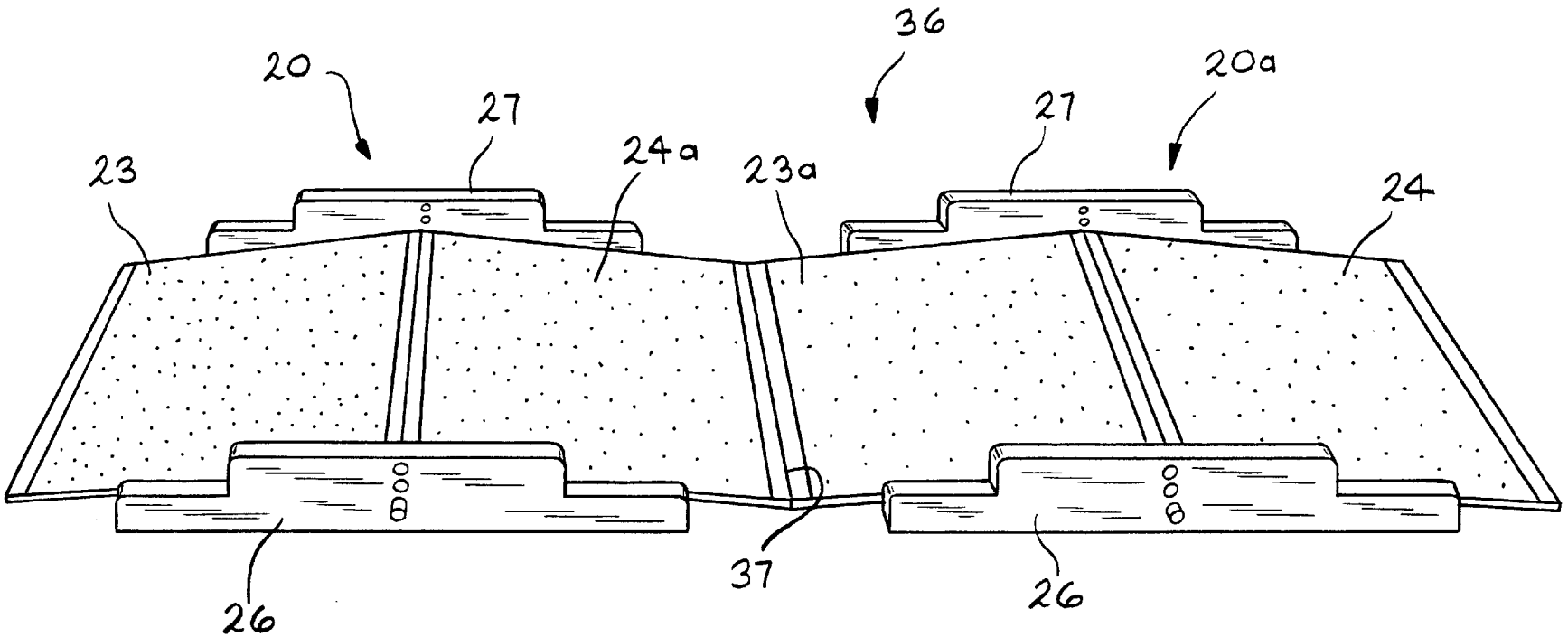
FIG. 10 is a perspective view of a modified embodiment of an adjustable physical therapy apparatus whereby two adjustable physical therapy devices are assembled in an end-to-end relationship to provide reversely inclined bounding platforms to provide stress to the medial aspects of injured ankles and knees.

As shown in FIG. 10, a modified embodiment of an adjustable physical therapy apparatus 36 is provided whereby two adjustable physical therapy devices 20 and 20*a*, respectively, are fixedly joined together in an end-to-end position along line 37 by any suitable connecting means well known in the art. Thus positioned, the modified embodiment creates a unique bounding surface for use by the patient which provides reversely inclined platforms 24*a* and 23*a* to provide stress to the medial aspects of the ankles and knees as opposed to the single unit stress provided to the lateral aspects of the injured ankles and knees.

In summary, an adjustable physical therapy apparatus is provided which is specifically adaptable for selective lateral rehabilitation exercises by a patient to improve the strength and stability of injured joints in the lower body extremities, i.e. ankles, knees and hips.

The adjustable physical therapy apparatus includes a support base. This support base has front and rear spaced-apart support walls. The front and rear support walls are provided with support rod receiving holes in parallel spaced-apart aligned vertical registry.

A platform assembly support rod is provided for selective operative engagement with the support rod receiving holes so as to selectively support a platform assembly thereon. The platform assembly support rod is adapted to coact with the support rod receiving holes so as to selectively vary the angle of inclination of a platform bounding assembly mounted thereon.

The platform bounding assembly is comprised of a pair of bounding platforms pivotally connected in an end-to-end relationship by a transverse hinge member so as to be selectively mounted upon the support rod. Each of the bounding platforms have support rod engaging stop bars at the ends thereof proximate to the hinge member so as to operatively engage the support rod upon which the platform bounding assembly is selectively mounted so as to stabilize the platform bounding assembly in its operative use position.

A modified embodiment of the adjustable physical therapy apparatus is provided wherein a second identical adjustable physical therapy apparatus is provided for selective fixed bounding platform end-to-end engagement therewith so as to provide a selective bounding platform assembly having reverse angle of inclination which provides a capability for resultant medial rehabilitation exercises by the patient.

Various other modifications of the invention may be made without departing from the principle thereof. Each of the modifications is to be considered as included in the hereinafter appended claims, unless these claims, by their language, expressly provide otherwise.

I claims:

1. In an adjustable physical therapy apparatus specifically adaptable for selective lateral rehabilitation exercises by a patient to improve the strength and stability of injured joints in the lower body extremities, the combination comprising;

a support base, said support base having front and rear spaced-apart support walls, each of said front and rear support walls provided with support rod receiving holes in parallel spaced-apart aligned vertical registry;

a platform bounding assembly including a pair of bounding platforms; and a platform assembly support rod provided for selective operative engagement with said support rod receiving holes so as to selectively support the platform assembly thereon, said platform assembly support rod sized and configured coact with said support rod receiving holes so as to selectively vary the angle of inclination of a platform bounding assembly mounted thereon; wherein a transverse hinge member pivotally connects said bounding platforms in an end-to-end relationship so as to be selectively mounted upon said support rod and each of said bounding platforms has support rod engaging stop bars at the ends thereof proximate to said hinge member so as to operatively engage said support rod, upon which said platform bounding assembly is selectively mounted, so as to stabilize the platform bounding assembly in its operative use position.

2. A physical therapy system comprimising two adjustable physical therapy apparatus of claim 1 wherein a second adjustable physical therapy apparatus is provided for selective it fixed to the bounding platform of a first adjustable physical therapy apparatus in an end-to-end engagement therewith so as to provide a selective bounding platform assembly having a reverse angle of inclination which provides a capability for resultant medial rehabilitation exercises by the patient.

* * * * *